US009359044B2

(12) United States Patent
Langelaan

(10) Patent No.: US 9,359,044 B2
(45) Date of Patent: Jun. 7, 2016

(54) WEIGHT-SHIFT CONTROLLED PERSONAL HYDROFOIL WATERCRAFT

(71) Applicant: Jacob Willem Langelaan, State College, PA (US)

(72) Inventor: Jacob Willem Langelaan, State College, PA (US)

( * ) Notice: Subject to any disclaimer, the term of this patent is extended or adjusted under 35 U.S.C. 154(b) by 0 days.

(21) Appl. No.: 14/509,289

(22) Filed: Oct. 8, 2014

(65) Prior Publication Data

US 2015/0104985 A1 Apr. 16, 2015

Related U.S. Application Data

(60) Provisional application No. 61/889,071, filed on Oct. 10, 2013.

(51) Int. Cl.

| | |
|---|---|
| ***B63B 1/24*** | (2006.01) |
| ***B63B 35/79*** | (2006.01) |
| ***B63H 21/17*** | (2006.01) |
| ***B63H 21/21*** | (2006.01) |
| ***B63H 5/14*** | (2006.01) |
| *B63H 11/04* | (2006.01) |
| *B63H 1/16* | (2006.01) |

(52) U.S. Cl.

CPC ..... *B63B 1/248* (2013.01); *B63B 35/7926* (2013.01); *B63B 35/7943* (2013.01); *B63H 5/14* (2013.01); *B63H 21/17* (2013.01); *B63H 21/21* (2013.01); *B63H 1/16* (2013.01); *B63H 11/04* (2013.01)

(58) Field of Classification Search

CPC ..... B63B 1/248
USPC ..... 441/74, 79
See application file for complete search history.

(56) References Cited

U.S. PATENT DOCUMENTS

| | | | |
|---|---|---|---|
| 293,133 | A | 2/1884 | Applegate |
| 322,712 | A | 7/1885 | Harris |
| 326,241 | A | 9/1885 | Preston |
| 374,713 | A | 12/1887 | Smith |
| 427,435 | A | 5/1890 | Manville |
| 497,158 | A | 5/1893 | Allen |
| 506,237 | A | 10/1893 | Kinsman |
| 619,281 | A | 2/1899 | Cornish |
| 670,263 | A | 3/1901 | Whiton |
| 704,790 | A | 7/1902 | Gillinder |
| 714,426 | A | 11/1902 | Wirth |
| 723,235 | A | 3/1903 | Brachhausen |

(Continued)

FOREIGN PATENT DOCUMENTS

| | | | |
|---|---|---|---|
| CH | 591358 | A5 | 9/1977 |
| CN | 202264871 | U | 6/2012 |

(Continued)

*Primary Examiner* — Lars A Olson
*Assistant Examiner* — Jovon Hayes
(74) *Attorney, Agent, or Firm* — Lerner, David, Littenberg, Krumholz & Mentlik, LLP

(57) ABSTRACT

A passively stable personal hydrofoil watercraft that has a flotation device, wherein a user can ride in a prone, kneeling, or standing position. The watercraft includes a strut having an upper end interconnected with the flotation device and lower end connected with a hydrofoil. The hydrofoil greatly reduces the power required to travel at higher speed. The watercraft also includes a propulsion system connected to the hydrofoil. Both longitudinal and directional control of the watercraft is via weight shift, eliminating the need of any movable surfaces. The flotation device, strut, and hydrofoil may be permanently interconnected or may be detachable.

22 Claims, 4 Drawing Sheets

(56) References Cited

U.S. PATENT DOCUMENTS 773,155 A 10/1904 O'Neill
2,110,812 A 3/1938 Negri
2,451,781 A 10/1948 Steele
2,748,400 A 6/1956 James
2,812,736 A 11/1957 Fry
2,815,518 A 12/1957 Kuehn
2,840,832 A 7/1958 Conger
2,891,259 A 6/1959 Perry
2,931,332 A 4/1960 Hebrank
3,019,760 A 2/1962 Berliner
3,105,249 A 10/1963 Palmore
3,150,632 A 9/1964 Evans
3,164,119 A 1/1965 Emmanuel et al.
3,213,822 A 10/1965 Sawchuck
3,227,123 A 1/1966 Voigt
3,254,622 A 6/1966 Bramson
3,262,413 A 7/1966 Bloomingdale et al.
3,265,027 A * 8/1966 Brown ..... B63H 11/00 114/278
3,294,055 A 12/1966 Mcguire
3,324,822 A 6/1967 Carter
3,340,845 A 9/1967 Tyrack
3,371,646 A 3/1968 Mela
3,380,421 A 4/1968 Lstiburek
3,405,677 A * 10/1968 Smith ..... B63B 35/7943 114/55.53
3,456,613 A 7/1969 Smith
3,536,025 A 10/1970 Tierney
3,548,778 A 12/1970 Von Smagala-Romanoff
3,747,138 A 7/1973 Morgan
3,882,815 A 5/1975 Bennett
3,964,417 A 6/1976 Williams et al.
RE28,955 E 9/1976 Stanberry, Sr. et al.
4,020,782 A 5/1977 Gleason
4,274,357 A 6/1981 Dawson
4,508,046 A 4/1985 Coulter et al.
4,971,586 A 11/1990 Walsh
5,017,166 A 5/1991 Chang
5,062,378 A 11/1991 Bateman
5,471,942 A 12/1995 Miller et al.
5,809,926 A * 9/1998 Kelsey ..... B63B 1/286 114/274
5,947,788 A 9/1999 Derrah
6,019,059 A * 2/2000 Kelsey ..... B63B 1/28 114/274
6,142,840 A 11/2000 Efthymiou
6,178,905 B1 * 1/2001 Dynes ..... B63B 1/285 114/55.54
6,183,333 B1 2/2001 Hall
6,192,817 B1 2/2001 Dec et al.
6,311,631 B1 11/2001 Beecher
6,409,560 B1 * 6/2002 Austin ..... B63B 35/7943 440/6
6,568,340 B2 5/2003 Dec et al.
6,702,634 B2 3/2004 Jung
6,901,872 B1 6/2005 Battle et al.
7,047,901 B2 * 5/2006 Chen ..... B63B 1/246 114/274
7,089,875 B2 8/2006 Kurze
7,144,285 B1 12/2006 Hendricks
7,207,282 B1 4/2007 Ruan et al.
7,232,350 B1 6/2007 Krah
7,232,355 B2 * 6/2007 Woolley ..... B63B 1/248 114/253
7,298,056 B2 11/2007 Gizara
7,731,555 B2 * 6/2010 Railey ..... B63B 35/7943 440/6
7,832,349 B2 * 11/2010 Dansie ..... B63B 1/24 114/274
7,854,637 B2 * 12/2010 Schultz ..... B63H 5/14 440/67
7,930,985 B2 4/2011 Walworth et al.
7,963,814 B2 6/2011 Grimmeisen
8,636,552 B2 1/2014 Braden et al.
8,702,458 B2 4/2014 Preston
8,870,614 B2 10/2014 Railey
9,060,385 B1 6/2015 Manning
2001/0007235 A1 7/2001 Dynes et al.
2001/0042498 A1 11/2001 Burnham
2002/0056408 A1 5/2002 Dec et al.
2002/0072285 A1 6/2002 Jung
2002/0124783 A1 * 9/2002 Dynes ..... B63B 1/285 114/55.54
2003/0167991 A1 9/2003 Namanny
2004/0139905 A1 7/2004 Chen
2005/0109258 A1 * 5/2005 Smith ..... B63B 1/24 114/274
2006/0094310 A1 5/2006 Railey
2007/0046028 A1 3/2007 Gizara
2007/0089657 A1 4/2007 Ruan et al.
2007/0245943 A1 * 10/2007 Rice ..... B60V 1/08 114/272
2007/0283865 A1 12/2007 Railey
2008/0078316 A1 4/2008 Gizara
2008/0168937 A1 7/2008 Ruan et al.
2008/0173225 A1 7/2008 Proto
2009/0165690 A1 7/2009 Walworth et al.
2009/0221198 A1 9/2009 Townsend
2010/0167605 A1 * 7/2010 Schultz ..... B63H 5/14 440/67
2010/0233920 A1 9/2010 Railey
2010/0323568 A1 * 12/2010 Chambers ..... B63B 35/793 441/79
2011/0003521 A1 1/2011 Roman
2011/0056423 A1 3/2011 Railey
2011/0201238 A1 8/2011 Rott et al.
2011/0212691 A1 9/2011 Rott et al.
2011/0256518 A1 10/2011 Rott
2012/0000409 A1 1/2012 Railey
2012/0073486 A1 3/2012 Railey
2012/0225598 A1 9/2012 Railey et al.
2013/0059489 A1 3/2013 Vlock et al.
2013/0104787 A1 5/2013 Roman
2013/0239861 A1 9/2013 Gizara
2014/0007802 A1 1/2014 Railey
2014/0134900 A1 5/2014 Derrah
2014/0349531 A1 11/2014 McLelan
2015/0011133 A1 1/2015 Vlock et al.
2015/0064995 A1 3/2015 Woods et al.
2015/0083034 A1 3/2015 Howes
2015/0104985 A1 * 4/2015 Langelaan ..... B63H 21/17 440/6
2015/0251734 A1 9/2015 Roman

FOREIGN PATENT DOCUMENTS

DE 3070662 6/1985
DE 4100890 A1 7/1992
DE 102004049615 A1 4/2006
DE 202012012844 U1 2/2014
DE 102013218735 A1 3/2015
EP 2700571 A2 2/2014
FR 2728863 A1 7/1996
FR 2755090 A1 4/1998
FR 2766154 A1 1/1999
JP 2012025293 A 2/2012
KR 2014024816 A 3/2014
WO 2006014085 A1 2/2006
WO 2007088351 A1 8/2007
WO 2011050410 A1 5/2011
WO 2011075808 A1 6/2011
WO 2011100654 A2 8/2011
WO 2011130724 A2 10/2011
WO 2012003333 A1 1/2012
WO 2013173182 A1 11/2013
WO 2013191501 A1 12/2013

* cited by examiner

WEIGHT-SHIFT CONTROLLED PERSONAL HYDROFOIL WATERCRAFT

CROSS-REFERENCE TO RELATED APPLICATION

This application claims priority to U.S. Provisional Patent Application Ser. No. 61/889,071, filed Oct. 10, 2013, the contents of which are incorporated herein in their entirety.

FIELD OF THE INVENTION

The present invention relates to personal watercraft; specifically, an electrically powered hydrofoil surfboard that is controlled by weight shift.

BACKGROUND OF THE INVENTION

Hydrofoils have been used on surfboards (U.S. Pat. No. 5,062,378, Bateman; U.S. Pat. No. 3,747,138, Morgan; U.S. Pat. No. 7,144,285 B1, Tareah), sailboards (U.S. Pat. No. 4,508,046 Shannon), water skis (U.S. Pat. No. 7,232,355, Woolley), and devices for swimmers (U.S. Pat. No. 2,931,332, Hebrank) as well as ships and boats (e.g. U.S. Pat. No. 3,227,123 Voigt). The purpose of hydrofoils on surfboards is typically to enable higher speeds and to lift the surfboard above the choppy, turbulent surface of the water, thus enabling surfing on larger waves. On sailboards and kiteboards, hydrofoils enable higher speeds; and on water skis hydrofoils enable new forms of trick skiing.

Powered surfboards have been developed for reducing the effort required in paddling (U.S. Pat. No. 7,731,555 B2 Railey) and as personal watercraft (U.S. Pat. No. 6,702,634 B2 Jung, U.S. Pat. No. 3,262,413 Bloomingdale et al., U.S. Pat. No. 6,192,817 B1 Dec, U.S. Pat. No. 4,971,586 Walsh, U.S. Pat. No. 4,274,357 Dawson). A particularly well-designed example of this type is the Jet-Surf (http://www.jet-surf.es). However, significant power is required to achieve speeds typical of surfing (up to ten horsepower to achieve thirty miles per hour), precluding the use of battery-powered motors for operationally useful periods.

A major factor that distinguishes surfboards from other watercraft is that control (both speed and directional) is affected via weight shift rather than by moveable surfaces (such as rudders) or thrust vectoring. Indeed, other methods of transport (skateboards and snowboards) also rely heavily on weight shift, and this method of control is central to the experience of surfing, snowboarding, and skateboarding.

An electrically powered hydrofoil device is described in Chen (U.S. Pat. No. 7,047,901 B2). The watercraft in that disclosure has two main disadvantages. First, the device in Chen requires a stabilizing component that controls the depth of the hydrofoil. Second, a steering mechanism is used for directional control. Therefore it does not (and cannot) accurately mimic the experience of surfing or snow boarding.

A need therefore exists for a personal watercraft that provides improved control and performance while providing a "surfing feel." In addition, this personal watercraft should be mechanically simple, easy to transport, and easy to maintain.

SUMMARY OF THE INVENTION

Embodiments of the present invention improve upon the powered surfboard by incorporating a hydrofoil. The hydrofoil greatly reduces the power required to travel at "fun" speeds (ranging from twenty to thirty miles per hour, but can be higher or lower depending on the user), so that a battery-powered electric motor (rather than an internal combustion engine) can be used to power the propulsion system. This results in reduced noise and vibration as well as reduced environmental impact.

Embodiments of the present invention also improve upon the powered hydrofoil surfboard. The hydrofoil of the present invention has been designed to provide passive stability in the longitudinal direction, making traditional altitude control systems based on moveable surfaces unnecessary. Further, both longitudinal and directional control of the board is via weight shift, so that riding the board is similar in feel to surfing or snowboarding, and the lack of a mechanical steering system makes the craft lighter, reduces parts count, and reduces the likelihood of a mechanical failure. Speed control is provided through a combination of throttle and weight shift.

The prior art in powered hydrofoil surfboards have all relied on moveable surfaces for control, and have ignored the possibility of designing the hydrofoil for passive static stability. The watercraft of the present invention is specifically designed to achieve desired levels of stability and controllability without the need for moveable surfaces. This is done through a combination of airfoil design, planform design, and tailoring the span-wise twist distribution to achieve desired outcomes.

Specific hydrofoils can be designed for different purposes: a larger foil results in lower speeds, more suitable for training; smaller foils operate at higher speeds for more advanced user; and tuning of the specific profile, twist, and dihedral can also be used to tailor the board to the user. A fixed canard or horizontal tail surface can also be added to further improve passive longitudinal stability as a training aid while still requiring the use of weight shift for control. A fixed vertical tail can be added to improve lateral stability as a training aid while still requiring the use of weight shift for control.

DETAILED DESCRIPTION OF THE INVENTION

Figure 1:
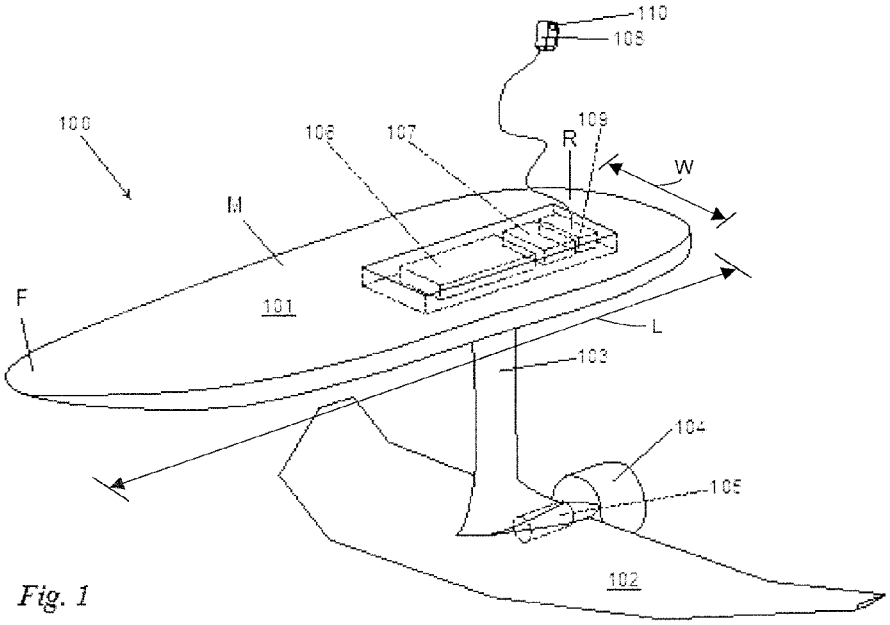
FIG. 1 is a perspective view of a personal hydrofoil watercraft in accordance with the present invention.

Referring to FIG. 1, a perspective view of a hydrofoil watercraft 100 in accordance with an embodiment of the present invention is shown. Watercraft 100 may include a flotation board 101, a hydrofoil 102 spaced below the flotation board, a strut 103 connecting the hydrofoil to the board, a propulsion system 104, an electric motor 105, a battery 106, a motor speed controller 107, a throttle system 108, a throttle interface 109, and a spring-loaded trigger 110.

The flotation board 101 of FIG. 1 is similar to those used in surfing or sailboarding. In the illustrated embodiment, the flotation board has a fore-aft length L that is greater than its lateral width W. Generally, the ratio of lateral width W to length L may be between 0.2 and 0.5. The length L will generally be in the range of 5 to 8 feet and the width W will generally be in the range of 1.5 to feet. The primary function of the flotation board is to provide flotation at low speeds, and it is preferentially configured with a flat upper surface to allow an adult human to lie prone, sit, kneel or stand on it and an opposed bottom surface facing the water. The lower surface may be almost flat to permit good hydroplaning.

The flotation board 101 can be made of foam, fiber-reinforced epoxy (using glass, carbon, or Kevlar fibers), or other suitable materials known to those of skill in the art. It may have a watertight compartment defined therein to contain the battery 106, motor speed controller 107 and throttle interface 109. The flotation board 101 provides an attachment structure for attaching the strut 103. The attachment structure may be a releasable mechanism to permit easy assembly and dis-assembly for transport. The flotation board 101 may be said to have a forward section F at the front end, a rear section R at the rear end and a middle section M intermediate the front and rear ends. Element M may also represent a midpoint that is halfway between the front and rear ends. As shown, the strut 103 is connected to the flotation board between the middle section M and the rear section R. The connection is behind the midpoint M and centered side to side. A throttle cable may connect the throttle module 108 to the throttle interface 109 or wireless communication may be provided between the throttle module 108 and throttle interface 109. In an alternate arrangement, the batteries 106 may be contained in the strut 103 or embedded in the hydrofoil 102. Each configuration has advantages and disadvantages ranging from ease of access for charging (in the case of a compartment in the flotation board) to reduction in the length of wires needed to connect the battery to the motor (in the case of containment in the strut or hydrofoil).

The strut 103 can be made of extruded aluminum, fiber-reinforced epoxy (using glass, carbon, or Kevlar fibers), or other suitable materials known to those of skill in the art. As shown, the strut is streamlined in cross-section to minimize drag. The strut may be constructed so as to allow passage of electrical wires from the motor speed controller 107 to the electric motor 105, such as inside or attached to the strut. The primary function of the strut is to rigidly connect the hydrofoil 102 at a fixed distance H from the board 101. The distance H will generally be in the range of 1 to 4 feet. In an alternative embodiment, more than one strut may be used or the strut may be shaped differently than shown.

The hydrofoil 102 of FIG. 1 is specifically designed to be statically stable in the longitudinal degrees of freedom via a combination of airfoil design, planform design and span-wise twist distribution. The hydrofoil 102 has a wingspan S (see FIG. 2). The wingspan will generally be in the range of 1 to 4 feet. It is also designed to be stable in sideslip ("weathercock stability") either via planform design or via the addition of small vertical foils (winglets or fins). In some cases it may be advantageous to add a fixed canard or horizontal tail to further enhance static longitudinal stability (for example, for training purposes). The fixed distance H (see FIG. 2) of the strut 103 may be greater than the wingspan S of the hydrofoil 102 so that the hydrofoil remains fully submerged even when the user is leaning to turn.

The propulsion system 104 (discussed in more detail below) may comprise a ducted propeller or pump-jet, or may be of another type. The propulsion system is driven by the electric motor 105.

The electric motor 105 is connected to the motor speed controller 107 using wires sized to carry the required voltage and current. The motor speed controller 107 may include other functionality such as a low-voltage alarm or other protective circuitry for the battery 106; alternately, such circuitry may be included in the throttle interface 109. The main function of the throttle interface is to connect the motor speed controller 107 to the throttle module 108.

The throttle module 108 may be a hand-held device with a spring-loaded trigger 110 (so the throttle disengages automatically when it is released). Pulling or depressing the trigger causes the motor to turn a propeller or impeller in the propulsion system 104, with motor speed being proportional to the degree the trigger is pulled or depressed. The throttle module communicates the degree of trigger pull/depression to the throttle interface 109 via a cable or wirelessly. The throttle module may take other forms, such as being operated by other body parts.

The throttle interface 109 may in addition include circuitry and connections to permit charging of the battery 106. This would include battery protection circuits. The throttle interface may also include a means to display battery information to the user (for example, via LEDs to indicate charge state). Alternately, such information may be displayed on the throttle module 108.

To operate the watercraft 100, a user initially lies prone on the flotation board 101. The throttle is engaged, causing the craft to accelerate. As the craft gains speed the user may move to a kneeling or standing position. As the craft further gains speed the hydrofoil generates sufficient lift to raise the board above the water. The user controls altitude of the board by leaning back (to go up) and forward (to go down). The user can steer left or right by leaning in the appropriate direction. Releasing the throttle causes the motor to stop, reducing speed. The watercraft 100 may have other safety devices and features which causes the electric motor 105 to stop when the rider falls off the flotation board 101. These devices may monitor the presence of a user on the flotation board 101.

Figure 2:
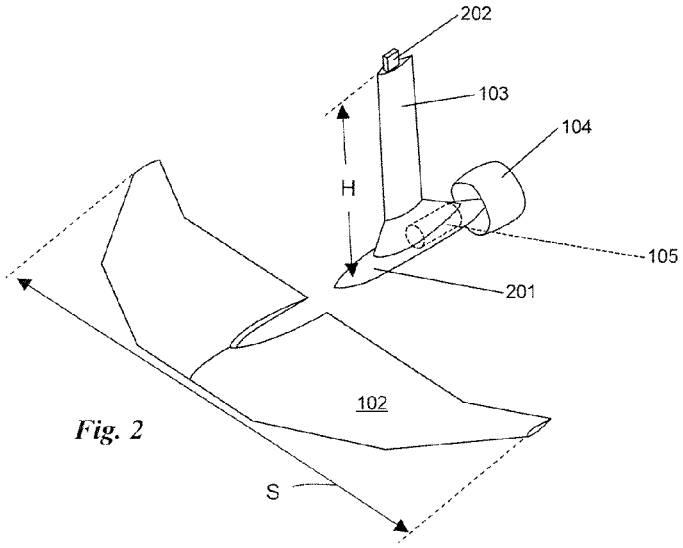
FIG. 2 is an exploded perspective view showing one embodiment of the hydrofoil and propulsion system assembly.

FIG. 2 shows an exploded perspective view of one embodiment of the hydrofoil 102, strut 103, propulsion system 104, and electric motor 105. The electric motor 105 and propulsion system 104 are integrated into a waterproof, streamlined pod 201 that is designed to be embedded in the hydrofoil 102. The pod 201 also defines the lower end of the strut 103. The streamlined pod performs two main structural functions: it transmits propulsion forces to the strut 103 and it transmits lift forces from the hydrofoil 102 to the strut 103. It may also contain provisions for cooling the electric motor 105. The pod 201 is connected to the hydrofoil 102 either by a fitting (so that the hydrofoil can be easily removed) or it is integrally manufactured with the hydrofoil 102.

In its preferential form the electric motor 105 is a high efficiency brushless motor. A gearbox may be provided to ensure that the propeller or impeller of the propulsion system 104 operates over an appropriate range of speeds.

The strut 103 contains at its upper end a fitting 202 to attach the strut to the flotation board 101 of FIG. 1. This fitting fits into a complementary slot in flotation board 101 and may use one of several methods to attach the strut 103 to the flotation board 101: examples include bolts, pins, or latches. Any other attachment approach may be used, or the strut and/or foil and/or flotation board may be integrally formed or permanently interconnected.

Figure 3:
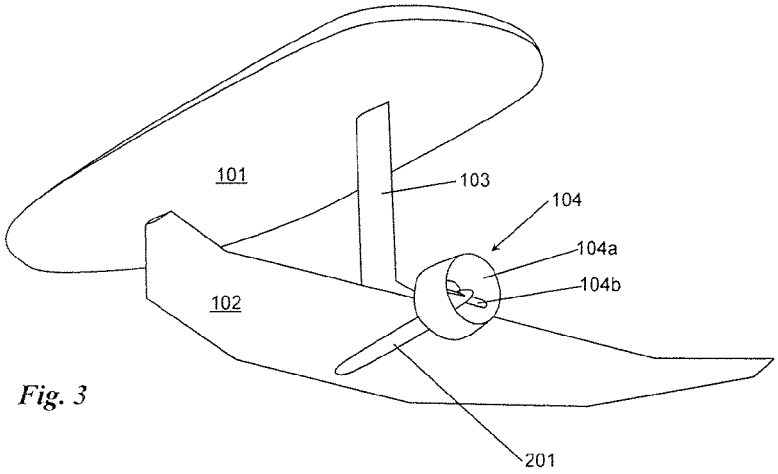
FIG. 3 is a perspective view from underneath a personal hydrofoil watercraft in accordance with the present invention.

FIG. 3 shows a perspective view of the watercraft 100 from below. In its preferred form the propulsion system 104 comprises a propeller 104*a* and a duct 104*b*. The duct has two purposes: it acts as a propeller guard and it is designed to increase propeller thrust. In an alternate form the propulsion system may comprise a pump-jet.

Figure 4:
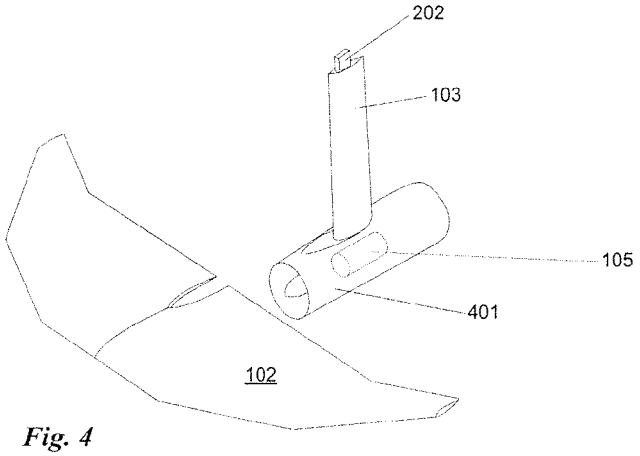
FIG. 4 is an exploded perspective view showing an alternate embodiment of the hydrofoil and propulsion system assembly.
Figure 5:
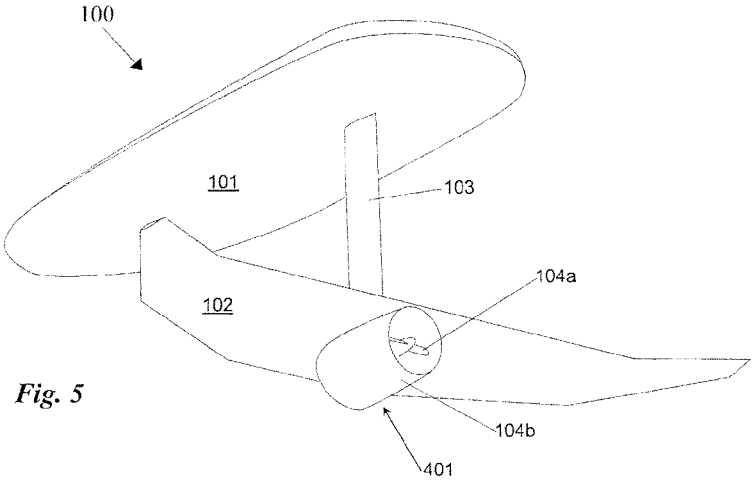
FIG. 5 is a perspective view from underneath a personal hydrofoil watercraft with the hydrofoil and propulsion system of FIG. 4.

FIG. 4 shows an exploded perspective view of an alternative embodiment of the hydrofoil 102, strut 103, electric motor 105 and propulsion system 401. In this embodiment the propulsion system comprises a long duct and may contain a stator assembly. The duct functions both as a guard for the propeller (shown in FIG. 3) and to improve hydrodynamic efficiency. A stator (not shown) aft of the propeller can also be included to improve propulsive efficiency. In this embodiment the electric motor 105 is enclosed in a streamlined pod embedded in the propulsion system. In the embodiment of FIG. 4, the propulsion system is mounted below the hydrofoil 102. FIG. 5 shows a perspective view of the watercraft 100 from below with the propulsion system 401 mounted below the hydrofoil 102.

Figure 6:
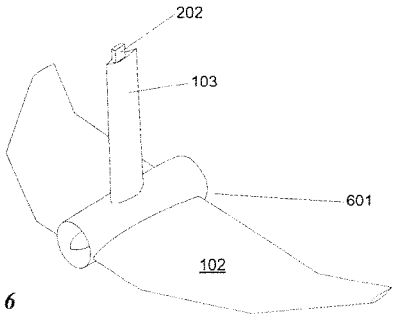
FIG. 6 is a perspective view of an embodiment of the hydrofoil and propulsion system as an integrated body.

FIG. 6 shows a perspective view of an alternative embodiment of the hydrofoil 102, strut 103, and propulsion system 601. In this embodiment the propulsion system is integrated in the hydrofoil so that the inlet is at or near the forward (leading) edge of the hydrofoil and the outlet is at or near the rear (trailing) edge of the hydrofoil. As in the embodiments of FIG. 2, FIG. 3, FIG. 4 and FIG. 5, the propulsion system comprises a duct, a propeller, electric motor, and may include a stator.

Figure 7:
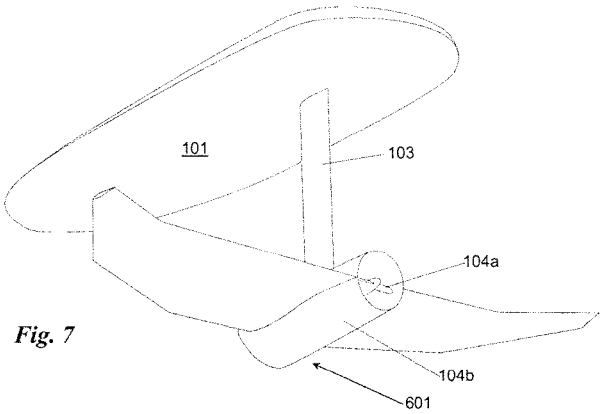
FIG. 7 is a perspective view from underneath a personal hydrofoil watercraft with the hydrofoil and propulsion system of FIG. 6.

FIG. 7 shows a perspective view of the watercraft 100 from below with the propulsion system of FIG. 6 integrated in the hydrofoil.

Figure 8:
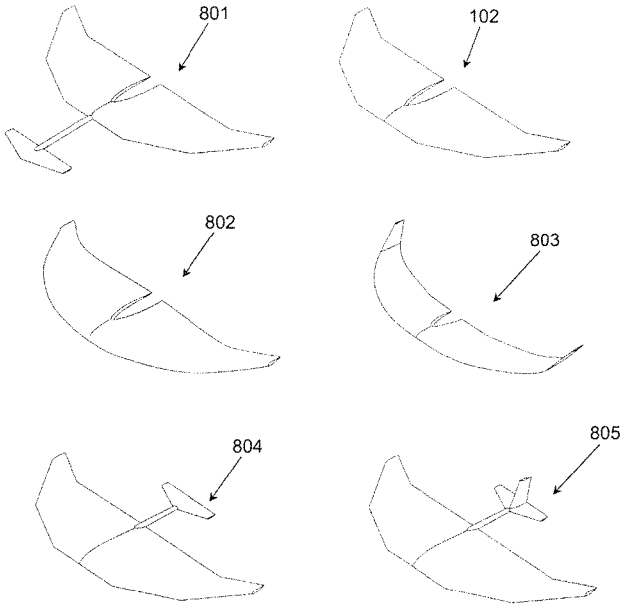
FIG. 8 shows perspective views of alternate examples of hydrofoil planform designs.

FIG. 8 shows perspective views of alternative embodiments of the hydrofoil planform. Hydrofoil 801 includes a fixed canard that increases stability (suitable for training). Note that this canard is fixed, not movable: control still occurs through weight shift. Hydrofoil 102 is shown in earlier drawings, and can be considered a baseline "all around" hydrofoil (suitable for a wide range of abilities). Foils 802 and 803 are progressively higher performance, permitting higher speeds and/or greater maneuverability. Foil 803 includes winglets, which increase directional stability and decrease drag. Foil 804 includes a horizontal tail, which improves longitudinal stability (similar to 801, it is suitable for training). Foil 805 includes both a horizontal tail and a vertical tail, improving longitudinal stability and directional stability (suitable for training). These tails may be considered a secondary hydrofoil. Note that other versions of the hydrofoil are possible: the key is designing the hydrofoil for passive static stability via planform design, airfoil design, and span-wise twist distribution.

Preferred embodiments of the present invention provide a hydrofoil watercraft with a fixed hydrofoil connected to a flotation board by one or more struts, with the fixed hydrofoil having no movable or adjustable surfaces. No movable hydrofoil is provided, but secondary hydrofoils on one or more struts (as shown in 801, 804, and 805) may be included. Additionally, no movable steering system is provided, as the watercraft is maneuvered by weight shifts.

Figure 9:
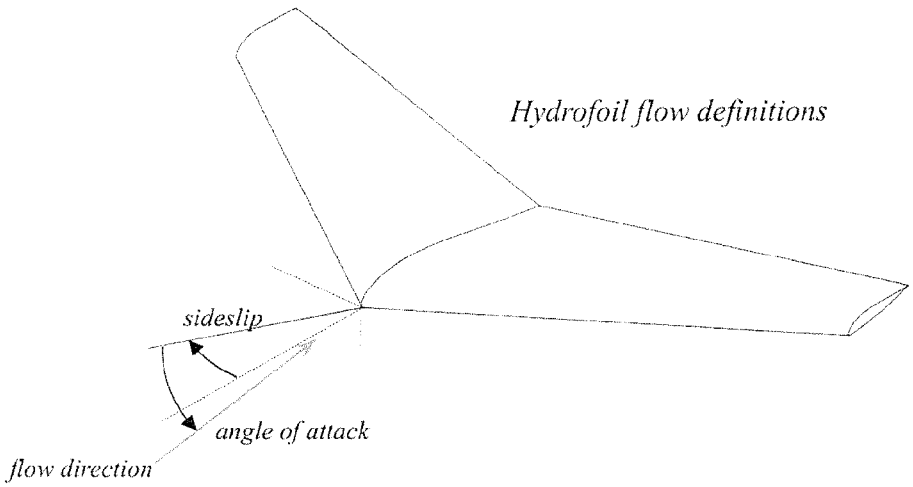
FIG. 9 is a schematic illustrating hydrofoil flow definitions.
Figure 10:
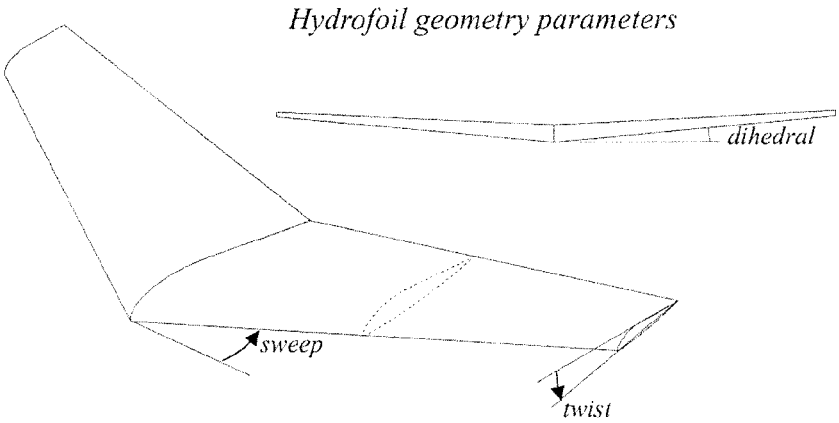
FIG. 10 is a schematic showing hydrofoil geometry parameters

This invention exploits passive stability to obviate the necessity for mechanisms or active control systems to provide stability. This passive stability allows the watercraft to be controlled by weight shift rather than by mechanical systems. FIG. 9 and FIG. 10 show the hydrofoil flow definitions and hydrofoil geometry parameters respectively. For the hydrofoil, longitudinally trimmed motion occurs when the total pitching moment is zero. This trim condition is stable if a disturbance results in a restoring moment that returns the hydrofoil to its original condition. The pitching moment coefficient can be written as $C_m=C_{m0}+C_{m_\alpha}\alpha+C_{m_Q}Q$ where $C_{m0}$ is the pitching moment coefficient at zero angle of attack and zero pitch rate, $C_{m_\alpha}$ is the derivative of pitching moment coefficient with respect to angle of attack (called pitch stiffness), $\alpha$ is the angle of attack (the angle between the flow direction and the chord of the hydrofoil), $C_{m_Q}$ is the derivative of pitching moment coefficient with respect to pitch rate (called pitch damping), and Q is the pitch rate. To ensure a trimmable, stable hydrofoil, the following conditions must be true: $C_{m0}>0$, $C_{m_\alpha}<0$, $C_{m_Q}<0$. This is achieved with a combination of airfoil selection, hydrofoil sweep and span-wise twist. The exact ratios of wing sweep and twist are dependent on the degree of stability desired and are also affected by the pitching moment characteristics of the airfoil. The derivative $C_{m_Q}$ determines the "quickness" of the longitudinal response. Typically it will lie between −2 and −20, with more negative values leading to a "sluggish" feel. In the steady state (when Q=0) the angle of attack (and thus speed) at which trim occurs is a function of $C_{m0}$ and $C_{m_\alpha}$.

$$\alpha_{trim} = -\frac{C_{m0}}{C_{m_\alpha}}$$

$C_{m0}$ is defined entirely by hydrofoil design parameters; $C_{m_\alpha}$ is defined by a combination of hydrofoil design parameters and the location of the center of gravity: this is the means by which weight shift enables longitudinal control of the hydrofoil watercraft.

Similarly for lateral motion, trim occurs when the yawing moment and rolling moment are zero. It is further desirable that this occurs at zero sideslip angle, so the hydrofoil "tracks straight" through the water. When the yaw rate is zero, rolling moment coefficient and yawing moment coefficient can be written as $$C_l=C_{l0}+C_{l\beta}\beta+C_{lP}P$$

$$C_n=C_{n0}+C_{n\beta}\beta+C_{nP}P$$

where $C_{l0}$ and $C_{n0}$ are the roll rate and yaw rate at zero sideslip, respectively, $C_{l_\beta}$ and $C_{n_\beta}$ are the derivatives of roll rate and yaw rate with respect to sideslip angle, respectively, $C_{l_p}$ and $C_{n_p}$ are the derivatives of roll rate and yaw rate with respect to roll rate, respectively. Note that $C_{n_\beta}$ is sometimes called weathercock stiffness and $C_{l_p}$ is sometimes called roll damping. Trimmable, stable motion at zero sideslip is achieved by ensuring that the following conditions are true:

$$C_{l0}=0$$

$$C_{n0}=0$$

$$C_{l_\beta}<0$$

$$C_{n_\beta}<0$$

$$C_{l_p}<0$$

This is achieved through a combination of sweep and dihedral and can also be influenced with the addition of winglets or a fin. The practical upper limit of $C_{n_\beta}$ and practical lower limits of $C_{l_\beta}$ and $C_{l_p}$ are determined by the practicality of hydrofoil design. For example, sweep angles greater that 60 degrees are unlikely to lead to useable designs and twist of greater than 15 degrees is unlikely to lead to useable designs. Given these geometric limits and the subjective judgment of "ride quality" on the part of a user, bounds on the roll and yaw derivatives exist but are not quantifiable to a useful degree of precision.

Directional control is achieved by the weight shift and the weathercock stability stiffness. Shifting weight to one side causes the watercraft to roll to that side; this causes sideslip in the direction of the weight shift, and the $C_{n_\beta}$ term causes the vehicle to turn in the direction of the lean. It should be noted that there is a trade-off between stability and maneuverability. More experienced users generally want a watercraft that is somewhat less stable to provide greater maneuverability. In contrast, less experienced users may want a watercraft that has more stability, and this may be done through appropriate design of the hydrofoil to give the desired stability and maneuverability characteristics.

As will be clear to those of skill in the art, the herein described embodiments of the present invention may be altered in various ways without departing from the scope or teaching of the present invention. It is the following claims, including all equivalents, which define the scope of the invention.

I claim:

1. A passively stable, weight-shift controlled personal hydrofoil watercraft, comprising:

a flotation device that has a fore-aft length greater than a lateral width, the flotation device having a top surface and a bottom surface, wherein a user can be disposed on the top surface of the flotation device in a prone, kneeling, or standing position, the flotation device having a forward section, a middle section, and a rear section, and the flotation device being controlled via weight shift of the user;

a strut having an upper end and a lower end, the upper end fixedly interconnected with the flotation device between the middle section and the rear section of the flotation device;

a hydrofoil fixedly interconnected with the lower end of the strut, the hydrofoil having no movable surface and designed to provide passive static stability controlled solely by weight shift of the user;

a propulsion system for propelling the watercraft in a body of water, wherein the propulsion system is connected to the hydrofoil; and the watercraft having no movable steering system.

2. A watercraft in accordance with claim 1, wherein the propulsion system comprises a battery, an electric motor, a motor speed controller, and a propulsor, the propulsor selected from a propeller, a ducted propeller, or a pump-jet.

3. A watercraft in accordance with claim 2, wherein the propulsor is disposed below the hydrofoil.

4. A watercraft in accordance with claim 1, wherein the propulsion system is integrated in a first hydrofoil wing of the hydrofoil and has an inlet near a leading end of the first hydrofoil wing and an outlet near a trailing edge of the first hydrofoil wing.

5. A watercraft in accordance with claim 1, wherein the design for providing the passive static stability is achieved through a combination of airfoil design, planform design and tailoring of span-wise twist distribution.

6. A watercraft in accordance with claim 1, wherein the hydrofoil is wing shaped with a front edge and a rear edge that both curve rearwardly.

7. A watercraft in accordance with claim 1, wherein the hydrofoil is indirectly connected to the strut.

8. A watercraft in accordance with claim 7, wherein the strut is directly connected to the propulsion system.

9. A watercraft in accordance with claim 8, wherein a first hydrofoil wing of the hydrofoil is indirectly connected to the strut through the propulsion system.

10. A watercraft in accordance with claim 7, wherein the hydrofoil comprises a plurality of wings that are interconnected by way of a strut.

11. A watercraft in accordance with claim 2, wherein the battery and motor speed controller are contained in a waterproof compartment integrated into the flotation device.

12. A watercraft in accordance with claim 2, wherein the electric motor is integrated into a waterproof, streamlined pod and the watercraft comprises a cooling system.

13. A watercraft in accordance with claim 2, wherein the electric motor is removably interconnected with the hydrofoil through a fitting.

14. A watercraft in accordance with claim 10, wherein the first hydrofoil wing includes winglets extending at an angle to a main body of the first hydrofoil wing.

15. A watercraft in accordance with claim 11, further comprising a wireless handheld controller having a transmitter, and a throttle interface having a receiver, wherein the transmitter is adapted to send wireless signals to the receiver that cause an output of the propulsion system to change.

16. A watercraft in accordance with claim 1, wherein a first hydrofoil wing of the hydrofoil is directly connected to the strut.

17. A watercraft in accordance with claim 1, wherein the hydrofoil is spaced a fixed distance apart from the flotation device.

18. A watercraft in accordance with claim 15, wherein the strut has an internal passage and electrical wires extend from the electric motor to the waterproof compartment inside the strut through the internal passage for controlling the electric motor.

19. A watercraft in accordance with claim 2, wherein the flotation device has a detector adapted to detect a user's presence on the flotation device and cease operation of the electric motor if the detector detects that the user is not on the flotation device.

20. A watercraft in accordance with claim 11, wherein the electric motor is a brushless motor.

21. A watercraft in accordance with claim 1, wherein the propulsion system is directly or indirectly connected to the hydrofoil.

22. A watercraft in accordance with claim 21, wherein the hydrofoil is directly connected to the strut, and the strut is directly connected to the propulsion system.

* * * * *